US005825288A

United States Patent [19]

Wojdan

[11] Patent Number: 5,825,288

[45] Date of Patent: Oct. 20, 1998

[54] MONITORING DEVICE FOR SWINGING DEADLOCK

[75] Inventor: Dennis Wojdan, Sparks, Nev.

[73] Assignee: Securitron Magnalock Corp., Sparks, Nev.

[21] Appl. No.: 841,772

[22] Filed: May 5, 1997

Related U.S. Application Data

[63] Continuation-in-part of Ser. No. 763,360, Dec. 11, 1996, Pat. No. 5,757,269.

[51] Int. Cl.[6] ..... E05B 45/06

[52] U.S. Cl. ..... 340/542; 340/686; 292/340; 70/436; 70/441

[58] Field of Search ..... 340/542, 686, 340/545, 549, 546, 541, 548; 292/340, DIG. 60, 341.16, 341.18, 144, 201; 200/61.68, 61.64, 61.67; 70/432, 434, 441, DIG. 32

[56] References Cited

U.S. PATENT DOCUMENTS

| | | | |
|---|---|---|---|
| 3,710,052 | 1/1973 | Jette, Jr. | 200/61.68 |
| 3,810,145 | 5/1974 | Gusaras | 340/686 |
| 3,967,080 | 6/1976 | Errani | 200/61.64 |
| 3,968,337 | 7/1976 | Cole | 200/61.62 |
| 4,465,997 | 8/1984 | Hines | 340/542 |
| 4,717,909 | 1/1988 | Davis | 340/686 |
| 4,935,587 | 6/1990 | Pattermann | 200/61.64 |
| 5,062,670 | 11/1991 | Grossman | 200/61.64 |
| 5,257,841 | 11/1993 | Geringer et al. | 292/340 |

*Primary Examiner*—Nina Tong
*Attorney, Agent, or Firm*—Gregory J. Nelson

[57] ABSTRACT

A monitoring device for narrow stile, metal frame doors having a mounting plate securable to the door jamb adjacent the strike slot. A switch is mounted on a bracket extending from the face plate and the switch is connectable to an existing alarm system. A trigger normally engages the switch actuator pin. When the closure or door is closed and the dead bolt engaged in the strike slot, the trigger will disengage the pin allowing the alarm system to be armed.

6 Claims, 2 Drawing Sheets

FIG. 7
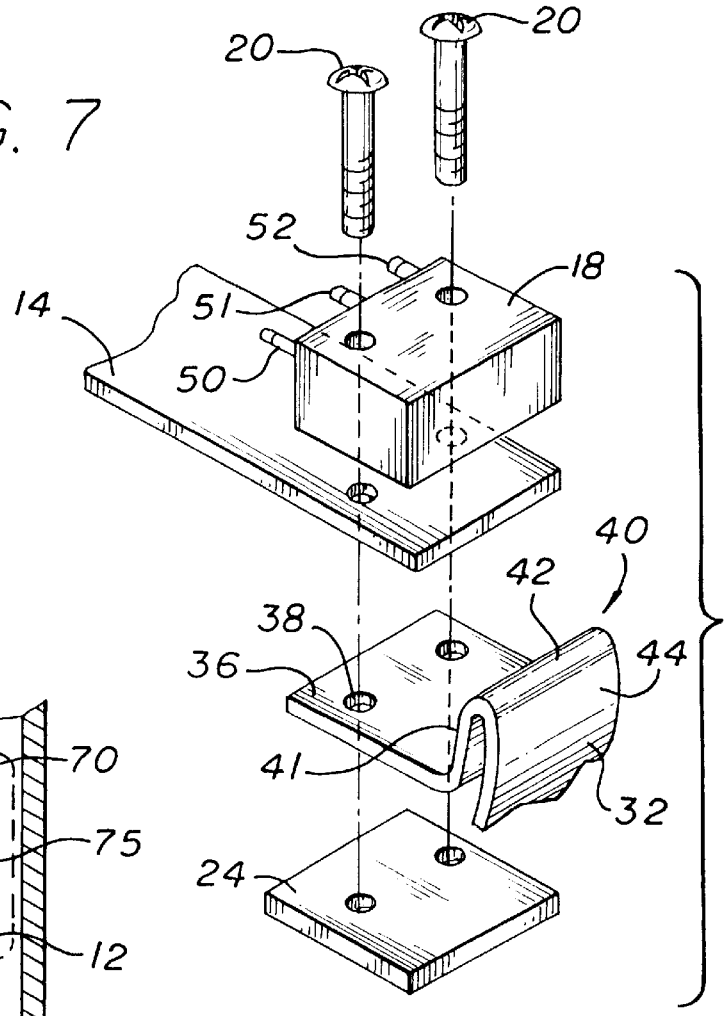
FIG. 6
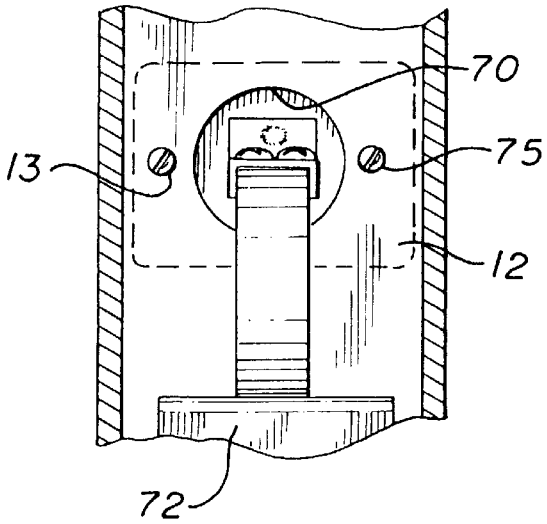
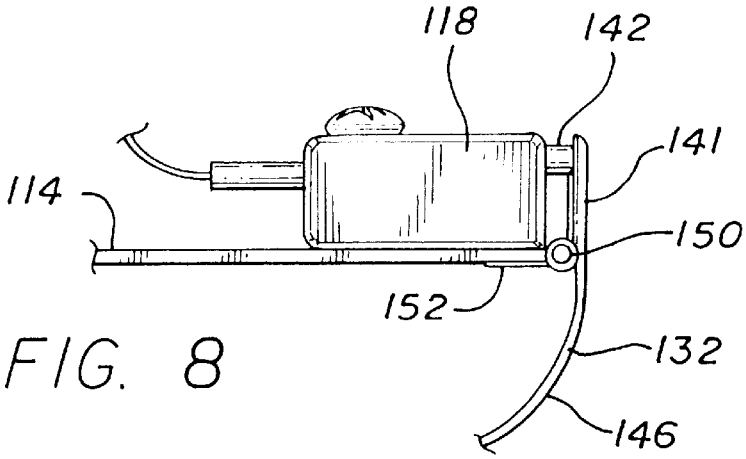
FIG. 8

MONITORING DEVICE FOR SWINGING DEADLOCK

CROSS-REFERENCE TO RELATED APPLICATION

The present application is a continuation-in-part of application Ser. No. 08/763,360, filed Dec. 11, 1996, now patented with U.S. Pat. No. 5,757,269 entitled "Latch Monitor".

BACKGROUND OF THE INVENTION

1. Field of the Invention

The present invention relates generally to alarm devices and more particularly relates to a monitoring device which provides an indication to an alarm system that a swinging deadlock of the type commonly used on narrow-stile, metal frame doors is in a secure or unsecured position.

2. The Prior Art

Various types of monitoring systems are found in the prior art which are used in connection with closable openings such as doors and windows and which are electrically connected to an alarm circuit to provide an indication of the position of the closure. If, for example, a door is not properly closed, the alarm system generally will not activate. Alarm systems generally monitor the position of doors by means of a door switch. Most door switches operate magnetically so that when the door is closed, the door switch is in one condition and when the door is opened a predetermined distance, as for example ½", the door switch is placed in a second condition. Such door position monitoring devices perform effectively and will notify an alarm system as to whether a door is opened or closed but such door switches do not provide any indication as to whether the door has been properly locked.

Accordingly, there exists in the prior art a latch monitoring device which can effectively provide an indication to the alarm system of the condition or position of a door latch or deadbolt and provide this information to the alarm system.

For example, U.S. Pat. No. 5,257,841 issued to Geringer et al discloses a lock strike device which has a strike box with spaced side walls and a closed rear wall and which is electrically connectable to a monitoring circuit. The first side wall and a portion of the rear wall define a cut-out through which a trigger extends into the strike space. The trigger is hinged at its front end to a box connected to the front of the side wall. The rear end of the trigger comprises a head which urges a spring-loaded lever of an electrical switch mounted on the exterior of the housing into an open circuit position. A movable tab extends transversely into the space from the trigger and the tab senses the presence of a latch to provide a signal to an indicator.

Another unit presently available in the commercial market place is the VonDuprin Model 4582 monitor strike which is manufactured by a division of Ingersoll Rand. This unit incorporates a replacement strike plate which mounts a mechanical switch behind it with a switch trigger protruding into the strike opening so that the entry of the latch into the opening depresses a trigger.

Another unit currently available is the ASSW-1048 Keeper Switch by Folger Adam. This unit addresses some of the disadvantages of the VonDuprin product. The Folger Adam unit retains the existing strike and mounts behind the existing strike. A series of slots allow adjustment of the trigger switch, both vertically and depth, to accommodate different latches and deadbolts.

U.S. Pat. No. 4,465,997 entitled "Exterior Mounted Door and Window Alarm Switch" shows several embodiments of the Folger Adam invention and in each instance the unit is mounted on the exterior of the door frame which may be architecturally and aesthetically objectionable.

Parent application, Ser. No. 08/763,360 referred to above, represents an improvement over prior art devices and provides an improved latch or bolt monitoring device which has a rectangular housing open on one side to admit the latch of the bolt. A pivot pin extends along one side wall and is mounted at opposite ends to the housing end walls. The pin pivotally supports a rocker plate which is spring biased to a rest position in which the strike plate surface of the rocker plate extends substantially the length and width of the entire latch opening within the housing. In the rest position, a portion of the rocker plate engages and depresses the actuator on a switch mounted on the side of the housing to maintain the switch in a first condition. When a latch or deadbolt is extended into the latch area, the rocker plate is engaged and is pivoted further into the housing causing the rocker plate to disengage from the actuator. Movement of the actuator changes the switch state to a second condition. In this second switch condition, with the latch or bolt properly within the strike area, the actuator is out of contact with the rocker plate flange so that even violent rattling of the door will not damage the switch.

While the various systems listed above are effective to report on the condition of a door latch in an alarm system, these devices are not designed to operate with a swinging deadlock of the type of lock commonly used in conventional narrow stile glass doors of the type having aluminum frames. Doors of this type are widely used in retail locations and in office buildings and security is an important consideration in these locations.

The need for a practical deadlock status monitoring switch can be appreciated when it is considered the manner in which alarm systems are commonly employed in locations such as retail stores having narrow stile doors. When the store is to be secured, the doors are locked and the alarm system armed. The alarm system will only alarm successfully if all of the monitoring points are secure. With respect to doors, this simply means that the doors are closed since, as indicated above, monitoring devices currently available do not provide an indication that the swinging deadbolt is properly in a locked condition. Accordingly, it is possible that an employee will close the door and the alarm system will properly arm. However, if the deadbolt is not properly engaged, the area is nevertheless unsecured. In this condition, an individual passing by the door may notice the unlocked condition of the door since there may be a considerable gap of ⅛" or more between the edge of the door and the frame. Accordingly, an apparently unlocked door will be an invitation to unauthorized entry. Further, if the door is unlocked, inadvertent movement of the door caused by a breeze or passer-by will place the door ajar and cause an alarm to be given.

Accordingly, the foregoing demonstrates there is a need for a monitoring device which will monitor the secure condition of deadlocks, particularly swinging deadlocks. If the door is not both properly closed and locked, the alarm system will not be able to be armed. Accordingly, failure of the system to arm will alert employees to a possible security breach and employees can check and properly lock the door. This advantage is particularly significant in view of the fact that many store employees are often relatively inexperienced, increasing the risk that the door is not properly secured.

SUMMARY OF THE INVENTION

Accordingly, the present invention provides a simple, effective and practical device for positively monitoring the condition of swinging deadlocks of the type used in connection with narrow stile doors. The invention is simple, can be inexpensively manufactured and easily installed and operates on existing, conventional deadlocks. Because of its design and simplicity, the present invention can be installed in a few minutes using basic tools such as a drill and screwdriver. The invention avoids the installer having to router out sections of the door so that the installation can be accomplished by an installer not having special training. Further, the installation does not impair or detrimentally effect the appearance or function of the door. Because of its simplicity, the present invention can be easily installed in new construction and can be easily retrofit to existing door installations.

The monitoring device of the present invention includes a mounting plate securable to the face of the door jamb adjacent the strike slot. A generally L-shaped bracket extends rearwardly from the mounting plate. An electrical switch is secured at the end of the bracket, the switch having a projecting actuator pin. The switch is provided with electrical connectors for convenient connection into existing alarm system. A trigger is secured to the end of the bracket and consists of a curved section of spring steel which, in the preferred embodiment, comprises a loop section adjacent the actuator on the switch. In the normal rest position, the loop section is positioned so that it engages the actuator pin placing the switch in a first condition. When the swinging deadbolt is properly engaged in the strike slot, the bolt comes into contact with the free or distal end of the trigger pivoting it upwardly toward the bracket. This movement will cause the loop section of the trigger to move away to disengage the trigger from the actuator pin thereby causing the switch to move a second, deactivated position.

In an alternate embodiment, the trigger may be a curved lever member which is pivotally attached to the end of the bracket and which has biasing means which will move the trigger to a first position when at rest and not engaged by a deadbolt.

The above and other objects and advantages of the present invention will be more fully appreciated and understood from the following description, claims and drawings in which:

FIG. 6 shows a face view of the door frame taken along line 6—6 of FIG. 4 illustrating the installation of the monitoring device of the present invention;

FIG. 7 is an exploded view of the switch and the ends of the bracket and trigger; and FIG. 8 is a side view of an alternate embodiment of the monitoring device.

DETAILED DESCRIPTION OF THE INVENTION

Turning now to the drawings, particularly FIGS. 1 to 7, the monitoring device of the present invention is generally designated by the numeral 10. The monitoring device 10 has a mounting plate 12 which is shown as being generally rectangular and defining a pair of spaced-apart mounting holes 13. The plate can be made of any material of suitable strength such as stainless steel.

Figure 4:
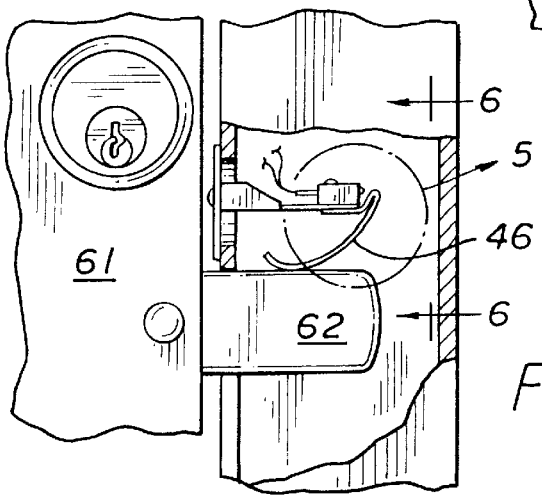
FIG. 4 is a view similar to FIG. 2 showing the deadlock in a properly latched position and the switch of the monitoring device in a second condition.

A bracket 14 extends rearwardly from the face plate at an intermediate location between the holes 13. The bracket has a generally planar base 15 and its forward end is bent to form a tab 16 which is disposed at a generally right angle with respect to the base. The tab is secured to the rear of the face plate by welding or other conventional fastening methods. The bracket has sufficient length so that when mounted on the face of a door frame adjacent the strike slot, the distal end of the bracket will extend to at least the depth of the fully-engaged bolt as seen in FIG. 4. A small switch 18 is secured to the end of the mounting bracket by appropriate means, in this case a pair of screws 20 extend vertically through the switch and are received in bores, not shown, in the end of the bracket. The end of the screws are each received in a nut 24 shown as a single nut having a pair of threaded holes 25. As will be explained below, the screws and nut also will serve to secure the trigger 32 to the bracket.

The switch may be of various types of switches but is preferably the type of switch manufactured by Honeywell (Model 11SX21-H58) or Omron Electronics (Model J-7) and having an actuator which is shown as a pin 30 which in the mounted position extends horizontally rearwardly to a location slightly beyond the distal end of the bracket. When the actuator pin is not engaged, the switch 18 is in a first condition. When the actuator pin is depressed, the switch 18 is in a second condition. The second condition is considered an at-rest position and in this position will provide an indication to the alarm system that a closure such as a door is in an open position and that the associated deadlock is not properly seated within the strike slot.

A trigger is secured to the end of the bracket. The trigger 32 consists of a single piece of flexible memory material such as stainless spring steel. The trigger includes a flat horizontal mounting portion 36 having a pair of bores 38 which are interposed between the underside of the bracket 14 and the nut 24 and held in place by the screws 20 and nut 24. The trigger includes a loop section 40 which extends upwardly parallel to the face plate having a bight section 42 at its upper end and a downwardly extending portion 44 which continues into a downwardly and forwardly extending arcuate portion 46. The end of the trigger is upwardly bent at 48. In the normal position, the inner leg 41 of the loop 40 serves as a strike surface and when at rest engages the actuator pin causing it to be depressed. This is the normal, at-rest position which provides an indication of a first switch condition to the alarm system to which the switch is connected. The switch is connected to the alarm system by a plurality of contacts 50, 52 and 54 which contacts are in the form of connector pins of conventional design which may be wired or received in the female portion of a connector plug.

The monitoring device of the present invention is designed to be used with deadlocks of the type represented by the MS series as manufactured by Adams Rite Manufacturing Company. The Adams Rite narrow stile deadlock is the original lock of this type and this lock and similar locks can be monitored by the present invention. FIGS. 2 to 5 illustrate the monitoring device mounted in a narrow stile door. The deadlock is represented by the numeral 60 and has a case 61 which is inserted into the edge of the door and is operated by a turn of a key in lock 65 or a thumb turn which retracts a counter-balanced bolt 62. The bolt typically will have a 1⅜" throw and may have a laminated construction of tamper-resistant material such as stainless steel. When the turn or key is rotated, the bolt is rotated into the strike to the locked position shown in FIG. 4.

Figure 1:
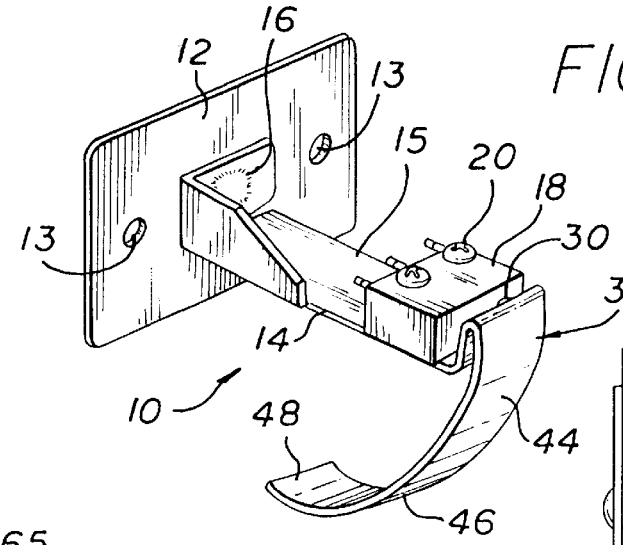
FIG. 1 is a perspective view of a preferred embodiment of the monitoring device of the present invention.
Figure 3:
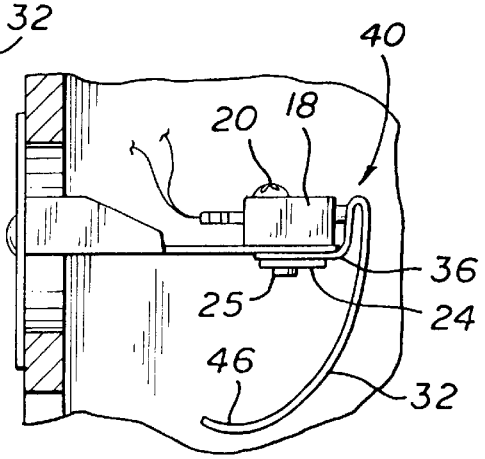
FIG. 3 is an enlarged view of the switch as indicated by the area 3 in FIG. 2.
Figure 2:
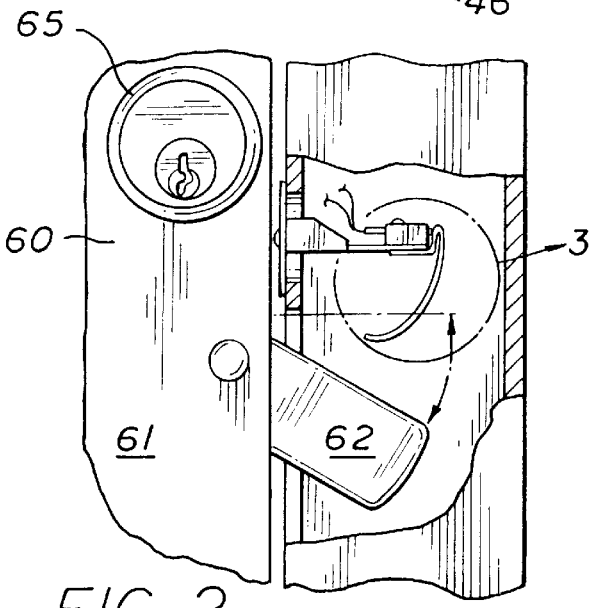
FIG. 2 is a side view of the device mounted in the door stile showing the deadlock not yet fully engaged and the switch in a first condition.

In the unlocked position shown in FIGS. 2 and 3, the bolt 62 is received within the case 61 and is out of contact with the monitoring device of the present invention and the loop portion 40 of the trigger will be in engagement with the actuator pin causing a signal of a first condition to be given to the alarm system. In this condition, the alarm system may not be armed since the door is not secure.

Figure 5:
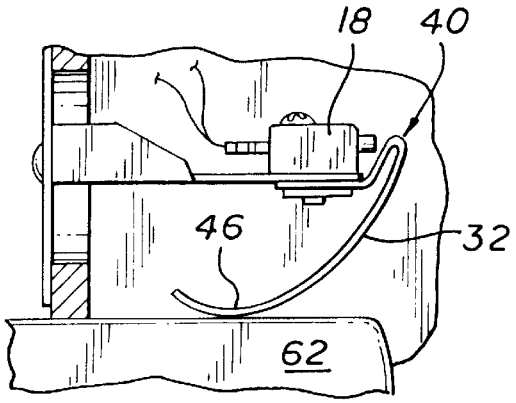
FIG. 5 is an enlarged view of the switch in a closed or latched position indicated by the area 5 in FIG. 4.

When the bolt is in the locked position shown in FIGS. 4 and 5, the bolt is pivoted upwardly bringing the upper edge of the bolt into contact with the arcuate section 46 of trigger 32. This will cause the trigger to be moved upwardly moving the loop 40 out of contact with the actuator pin 42 causing the switch 18 to be moved to a second condition in which condition an indication is provided to the alarm system that the door and deadlock are properly secure. In this condition, the alarm system may be armed.

FIG. 6 illustrates the installation of the monitor of the present invention in a narrow-stile door. The device may be easily installed by drilling a small hole 70 such as a 9/16" diameter hole in the metal door frame at a location above the strike slot 72. The trigger 32 is manually compressed which allows insertion of the monitoring device into the hole previously drilled. The monitoring device is secured in position by using suitable fasteners such as rivets 75 in the holes 13. Drive rivets are preferred and are commercially available and will secure the mounting plate to the door frame in a flush condition by inserting the drive rivets into the holes and tapping them in place with a hammer.

FIG. 8 shows an alternate embodiment of the present invention in which switch 118 is mounted on bracket 114. A trigger 132 is modified and consists of arcuate portion 146 and an upper planar end 141 is secured to the end of the mounting bracket 114 by a hinge 150. The hinge includes biasing means such as a return spring 152 acting between end 141 and the bracket which will normally place the upper end 141 of the trigger in contact with the actuator pin 142. When the bolt is properly in the strike slot, the bolt will engage the lower end of the trigger 132 causing the upper end 141 to be pivoted out of contact with the actuator pin. In other respects, the embodiment of FIG. 7 operates in the same manner as has previously been described.

Accordingly, it will be seen that the monitoring device of the present invention is suited for monitoring a swinging deadlock and communicating the condition of the deadlock to a local or remote monitoring device such as an alarm system. The monitoring device provides substantial advantages over the prior art in that it is easily installed without the requirement of any field adjustment or components. The trigger is dimensioned to extend inwardly and downwardly a sufficient distance within the strike slot so that it will be engaged by swinging deadbolts of different size. Similarly, the width of the trigger is sufficient to extend across a substantial portion of the opening in the strike slot so that even if misalignment occurs, the bolt will properly engage the trigger. No interfering components restrict the bolt or latch. The trigger is actuated with minimum bolt throw so the device accommodates various types and sizes of bolts. The design utilizes a minimum number of parts and is easy to manufacture, assemble and install and is reliable and rugged in use. It will be appreciated that even if a door is rattled violently, the force will not be transmitted to the switch since the trigger is out of contact with the switch when the bolt is in place. Thus, the monitoring device of the present invention is universal and will work even in installations where the latch or bolt is relatively small as the generous extension and dimension of the trigger occupying the strike area will allow the trigger to be contacted.

While the principles of the present invention have been made clear in the illustrated embodiments set forth above, it will be obvious to those skilled in the art to make various modifications to the structure, arrangement, proportion, elements, materials and components used in the practice of the invention. Although described in connection with doors, the invention can be used with other types of closures, not limited to windows, doors and gates. To the extent that these various modifications and applications do not depart from the spirit and scope of the appended claims, they are intended to be encompassed therein.

I claim:

1. A monitor for monitoring the condition of a door closure having a swinging deadlock receivable within a strike slot, said monitor comprising:

(a) a mounting plate mountable on the face of a door jamb adjacent the strike slot;

(b) a bracket having a base and adapted to be positioned to extend from said mounting plate into the strike slot in a mounted condition with an inner end thereof in the strike slot;

(c) an electrical switch on the bracket adjacent the inner end of said bracket, said electrical switch having an actuator which in a first position places the electrical switch in a first electrical condition and in a second position places the electrical switch in a second electrical condition; and (d) a trigger movably mounted at the inner end of said bracket adjacent said electrical switch, said trigger having a first surface and being biased to normally engage said actuator in a normal at-rest position placing the switch in the first electrical condition, said trigger having a second surface extending into the strike slot engageable by said deadlock when the deadlock is properly locked in said strike slot causing said trigger to pivot placing said first surface out of contact with said actuator, placing said switch in said second condition.

2. The monitor of claim 1 wherein said trigger comprises a spring member in which said first surface comprises a portion of loop wherein said second surface is generally curved.

3. The monitor of claim 2 wherein said trigger is spring steel.

4. The monitor of claim 1 wherein said trigger includes a hinge secured to said bracket and biasing means urging said trigger to said first position when at rest.

5. The monitor of claim 1 wherein said closure is a door having a narrow stile frame.

6. The monitor of claim 1 wherein said trigger extends generally downward and inwardly toward said door face from said bracket.

* * * * *